US011684967B2

(12) United States Patent
Aksit

(10) Patent No.: US 11,684,967 B2
(45) Date of Patent: Jun. 27, 2023

(54) ROTATIONAL SYMMETRICAL AND NON-SYMMETRICAL PLASTIC FORMING MACHINE

(71) Applicant: Tusas Motor Sanayii Anonim Sirketi, Eskisehir (TR)

(72) Inventor: Mahmut Faruk Aksit, Kocaeli (TR)

(73) Assignee: TUSAS MOTOR SANAYII ANONIM SIRKETI, Eskisehir (TR)

( * ) Notice: Subject to any disclaimer, the term of this patent is extended or adjusted under 35 U.S.C. 154(b) by 430 days.

(21) Appl. No.: 16/459,644

(22) Filed: Jul. 2, 2019

(65) Prior Publication Data

US 2020/0009641 A1 Jan. 9, 2020

(30) Foreign Application Priority Data

Jul. 3, 2018 (TR) ..... 2018/09473

(51) Int. Cl.
*B21J 5/06* (2006.01)
*B21J 5/04* (2006.01)

(52) U.S. Cl.
CPC .. *B21J 5/06* (2013.01); *B21J 5/04* (2013.01)

(58) Field of Classification Search
CPC ..... B21J 5/04; B21J 5/06; B21J 9/02; B21J 9/10; B21J 5/008; B21D 22/14; B21D 22/16; B21D 31/005
USPC ..... 72/75, 80
See application file for complete search history.

(56) References Cited

U.S. PATENT DOCUMENTS 1,316,300 A * 9/1919 Griffin ..... B21D 22/16 72/7.3
3,145,677 A * 8/1964 Sporck ..... B21D 22/16 72/83
3,731,433 A * 5/1973 Clarke ..... B23F 9/025 451/157
4,457,684 A * 7/1984 Gram ..... B30B 15/068 425/149
5,587,633 A * 12/1996 Aoki ..... B30B 15/14 318/164
6,112,391 A * 9/2000 Radocaj ..... B21D 22/16 29/33 R
2017/0144208 A1* 5/2017 Mikami ..... B21D 37/16

FOREIGN PATENT DOCUMENTS

EP 2952273 A1 12/2015

* cited by examiner

*Primary Examiner* — Shelley M Self
*Assistant Examiner* — Smith Oberto Bapthelus
(74) *Attorney, Agent, or Firm* — Bayramoglu Law Offices LLC

(57) ABSTRACT

A plastic forming machine including a fixed pole; a movable pole; a shaft for fixing a raw material; an electric motor for rotating the shaft; a linear movement system enabling the movement of the movable pole; a first pressing rod positioned on lower surface of the movable pole, includes a first arm extending parallel to the movable pole, a second arm extending vertical to the first arm, and a third arm, having a first end and second end, connected to the first arm from its second end; a second pressing rod having a first and a second end, is connected slidingly to the first arm from its first end; at least one actuator connected to the first arm; a contact end connected to the second ends of the second pressing rod and the third arm; at least one control system for controlling the linear movement mechanism and the actuator.

18 Claims, 4 Drawing Sheets

ROTATIONAL SYMMETRICAL AND NON-SYMMETRICAL PLASTIC FORMING MACHINE

CROSS REFERENCE TO THE RELATED APPLICATIONS

This application is based upon and claims priority to the Turkish Application No. 2018/09473, filed on Jul. 3, 2018, the entire content of which is incorporated herein by reference.

TECHNICAL FIELD

The present invention relates to working principle of a machine which is produced for plastic forming method of raw metal material. By means of the present invention, it is intended to create final geometry as a result of a continuous plastic shape changing by applying hydraulic force on raw material rotating at a certain speed on a shaft (heated in hot working) in equal or various rates from two directions.

BACKGROUND

Molds are used to obtained desired geometry in raw materials to be machined in the plastic forming machines known in the state of the art. Mold costs cause the total cost to increase. Again in these applications, intermediate products which are symmetrical or non-symmetrical forging components cannot be produced in a single step. More than one auxiliary apparatuses may be required for this. This increases intermediate product costs. Furthermore, the geometric precision is low in the parts obtained by conventional forging process; therefore the amount of material to be processed in the material removal machine and time is also high accordingly. In addition to these, while the desired form is given to the raw material by applying momentary force, this force that is applied should be controlled momentarily.

European patent document EP2952273, an application known in the state of the art, discloses a forging device for machining a workpiece which is connected on a table that is rotatable about a certain axis by means of rotating shaping rollers. In the related document, press force is applied by the movement of the rotating shaping rollers towards the workpiece, and it does not seem possible that non-symmetrical structures can be processed without an auxiliary apparatus. Since the movement of the shaping rollers is only in horizontal axis, precise geometries cannot be acquired in these machines with a single step. No heat is applied on the workpiece located on the rotating table. Therefore, it is difficult to perform plastic forming due to the fact that heat is not applied.

SUMMARY

The objective of the present invention is to provide a machine for the production of both symmetrical and non-symmetrical forging components by performing a plastic forming process with an application continuous pressure instead of a high-pressure momentary pounding effect without using a mold.

A further objective of the present invention is to ensure that the raw material undergoes plastic form change by applying a continuous hydraulic force from two directions in equal or various ratios to the raw material rotating at a certain speed on a shaft heated in hot forming. In this way, the desired product can be obtained in one process and no other apparatus or operations are needed. Therefore, cost is also reduced.

BRIEF DESCRIPTION OF THE DRAWINGS

A rotational symmetrical and non-symmetrical plastic forming machine developed in order to realize the objective of the present invention is illustrated in the accompanying figures, in which.

Figure 1:
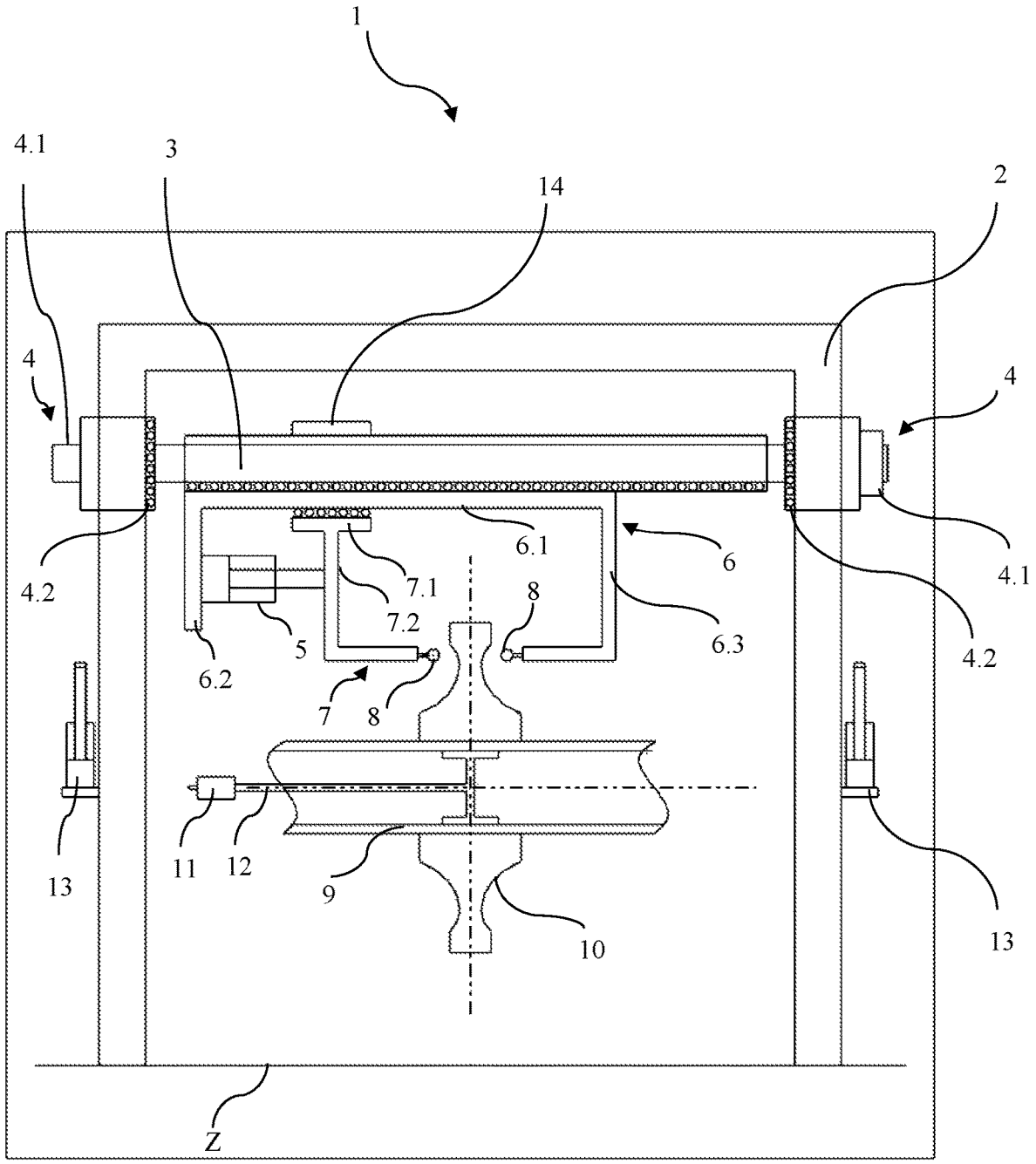
FIG. 1 is front view of a rotational symmetrical plastic forming machine.

The components shown in the figures are each given reference numbers as follows:

1. Plastic forming machine
2. Fixed pole
3. Movable pole
4. Linear movement system
4.1. Linear motor
4.2. First linear sliding bearing
5. Actuator
6. First pressing rod
6.1. First arm
6.2. Second arm
6.3. Third arm
7. Second pressing rod
7.1. Fourth arm
7.2. Fifth arm
8. Contact end
9. Shaft
10. Raw material
11. Electric motor
12. Shank
13. Stopping piston
14. Second linear sliding bearing
15. Control system
Z. Floor

DETAILED DESCRIPTION OF THE EMBODIMENTS

A rotational plastic forming machine (1), which is for processing material with symmetrical or non-symmetrical final geometry, essentially comprises at least one fixed pole (2), movable pole (3) which is positioned such that it will make right angle with the fixed pole (3), comprises at least one upper surface and one lower surface, at least one linear movement system (4) which is for the movable pole (3) moving on a vertical axis on the fixed pole (2), at least one first pressing rod (6) which comprises a first arm extending parallel to the movable pole (3); a second arm extending vertical to the first arm; a third arm comprising a first end and a second end, connected to the first arm from its second end; and which is positioned on the lower surface of the movable pole (3), a second pressing rod (7) which comprises a first and a second end, and which is connected to the first arm (6.1) in a sliding manner from its first end, an actuator (5) which is adapted to move the second pressing rod (7) in horizontal axis, and connected to the second arm (6.2), a contact end (8) which is connected to the second ends of the second pressing rod (7) and the third arm (6.3), a shaft (9) which is for fixing a raw material thereon, an electric motor (11) which is for rotating the shaft (9), a shank (12) one end of which is connected to the outlet of the electric motor and the other end of which is connected to the shaft, at least one control system (15) which is adapted to control the linear movement system (4) and the actuator (5).

In a preferred embodiment of the present invention, the plastic forming machine (1) which provides symmetrical processing of plastic materials is shown in FIG. 1, which comprises a fixed pole (2) preferably fixed on a floor (Z), and a movable pole (3) positioned therein such that it will make a right angle with the fixed pole (2). A linear movement system (4) enables the movement of the movable pole (3) in vertical axis. In another embodiment of the invention, there are two fixed poles (2) which are connected to each other from the top by means of an intermediate pole, and two linear movement systems (4) in order to provide movement of the movable pole (3) in vertical axis.

In the preferred embodiment of the invention, the said linear movement system (4) comprises a linear motor (4.1) and a first linear sliding bearing (4.2) which is driven by the linear motor (4.1), provided between the fixed pole (2) and the movable pole (3) and which comprises a rail mechanism.

There is a first pressing arm (6) positioned on the lower surface of the movable pole (3). The said first pressing arm (6) is comprised of three parts connected to each other. These parts are a first arm (6.1) extending parallel to the movable pole (3), comprising a first end and a second end; a second arm (6.2) extending from the first end of the first arm (6.1) towards the floor (Z); and a third arm (6.3) extending from the second end of the first arm (6.1) towards the floor (Z), preferable having an "L" shaped form. Preferably, the first arm, the second arm and the third arm are single-piece.

The first pressing rod (6) is connected to the movable pole (3) by means of a second linear sliding bearing (14) located therebetween so that the first pressing rod (6) can move on the horizontal axis on the movable pole (3).

At the bottom of the first pressing rod (6), there is a second pressing rod (7) with a contact end connected to its one end.

In an embodiment of the present invention, said second pressing rod (7) preferably comprises a fourth arm (7.1) extending parallel to the first arm (6.1), and a fifth arm (7.2) connected to this fourth arm (7.1), extending towards the floor (Z). Preferably, the said fourth arm (7.1) and the fifth arm (7.2) are manufactured as single-piece.

In order to provide movement of the first arm (6.1) and the second pressing rod (7) in horizontal axis, in other words to move them closer to each other and away from each other, there is an actuator (5). While the actuator (5) is connected from one end to the second arm (6.2) of the first pressing rod (6), it is connected from its other end to the fifth arm (7.2) of the second pressing rod (7). The actuator (5) is preferably a hydraulic piston; it may also be a pneumatic piston or an electric piston.

There are contact ends (8) extending correspondingly from one end of the third arm (6.3) and one end of the fifth arm (7.2), and having a fixed or rotating structure. A raw material (10) is placed between the contact ends (8) of the first pressing rod (6) and the second pressing rod (7) moving upon the operation of the actuator (5) in order to be processed peripherally. The said raw material (10) is wrapped around a temperature-controlled and rotatable shaft (9) for peripheral processing. In order to facilitate the processing of the raw material (10), its temperature is controlled via heating plates (not shown in the figures) placed on the inner surface of the shaft (9). The movement of the shaft (9) is provided by an electric motor (11) via a shank (12) engaging to the shaft. The force applied by the actuator (5) is transferred evenly on the raw material (10) through the contact ends (8) connected to the first pressing rod (6) and the second pressing rod (7). Thanks to the uniform distribution of the force on the first pressing rod (6) and the second pressing rod (7), it is ensured that the raw material (10) is processed symmetrically.

The plastic forming machine (1) comprises a control system (15). The said control system (15) control the position of the movable pole (3), the position of the first pressing rod (6) and the second pressing rod (7), and the force to be transferred to the raw material (10) to be processed via the contact ends (8) connected to the said rods by controlling the linear movement system (4) and the operation of the actuator.

In case the machine does not operate, the movement of the movable pole (3) in the vertical direction is limited preferably by means of the stopper pistons (13) positioned on the fixed pole (2).

Figure 2:
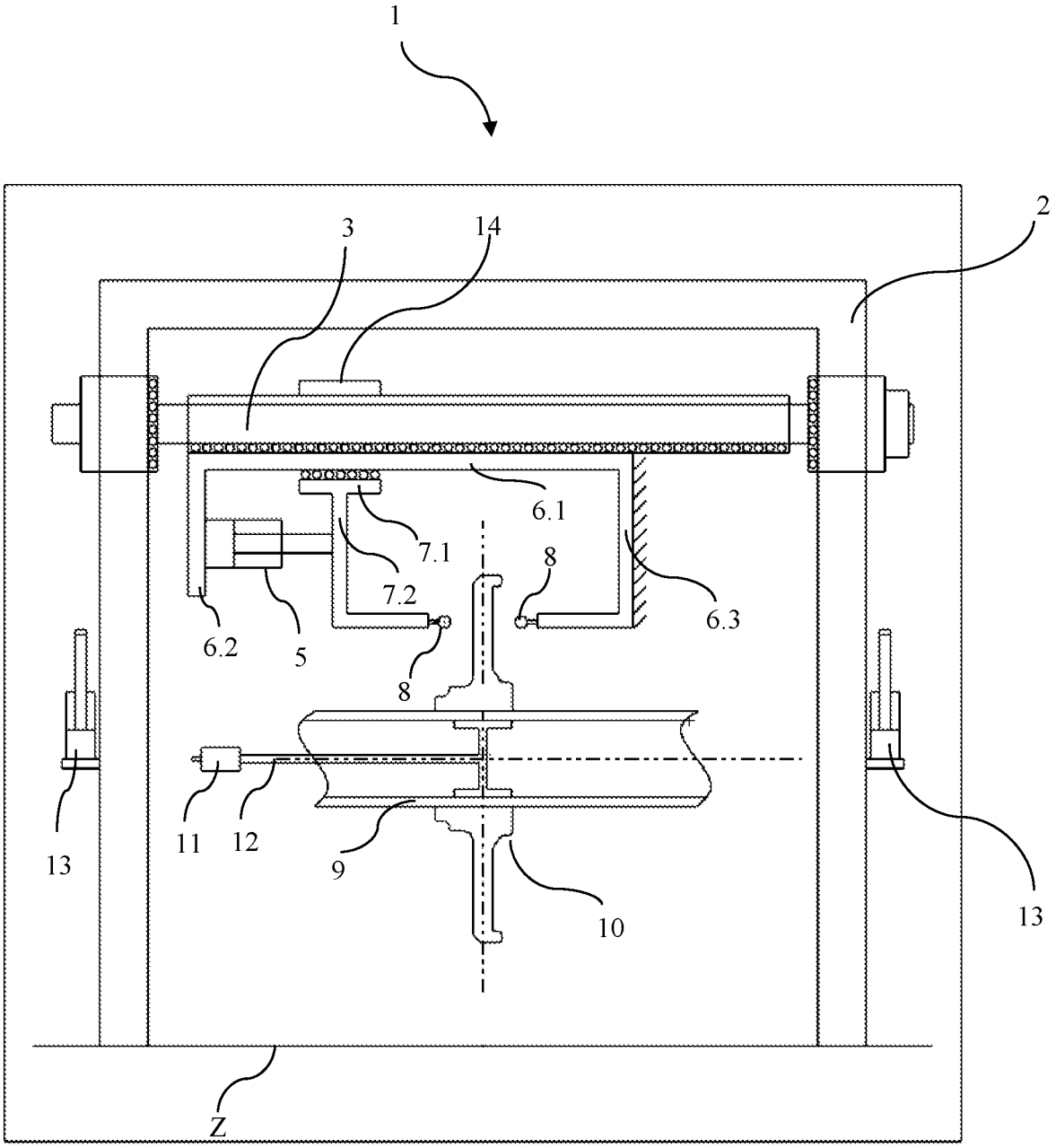
FIG. 2 is front view of a rotational non-symmetrical plastic forming machine.

In another preferred embodiment of the invention, the plastic forming machine (1) is shown in FIG. 2, in which non-symmetrical final geometry of the raw material (10) is obtained. In this embodiment, unlike the first embodiment described above, the first pressing rod (6) is fixed to the movable pole (3); thereby its horizontal movement is prevented. The force applied by the actuator (5) on the second pressing rod (7) is transferred to the contact end (8) connected to the fifth arm (7.2) of the second pressing rod (7), and thus the raw material (10) is enabled to be processed.

Figure 3:
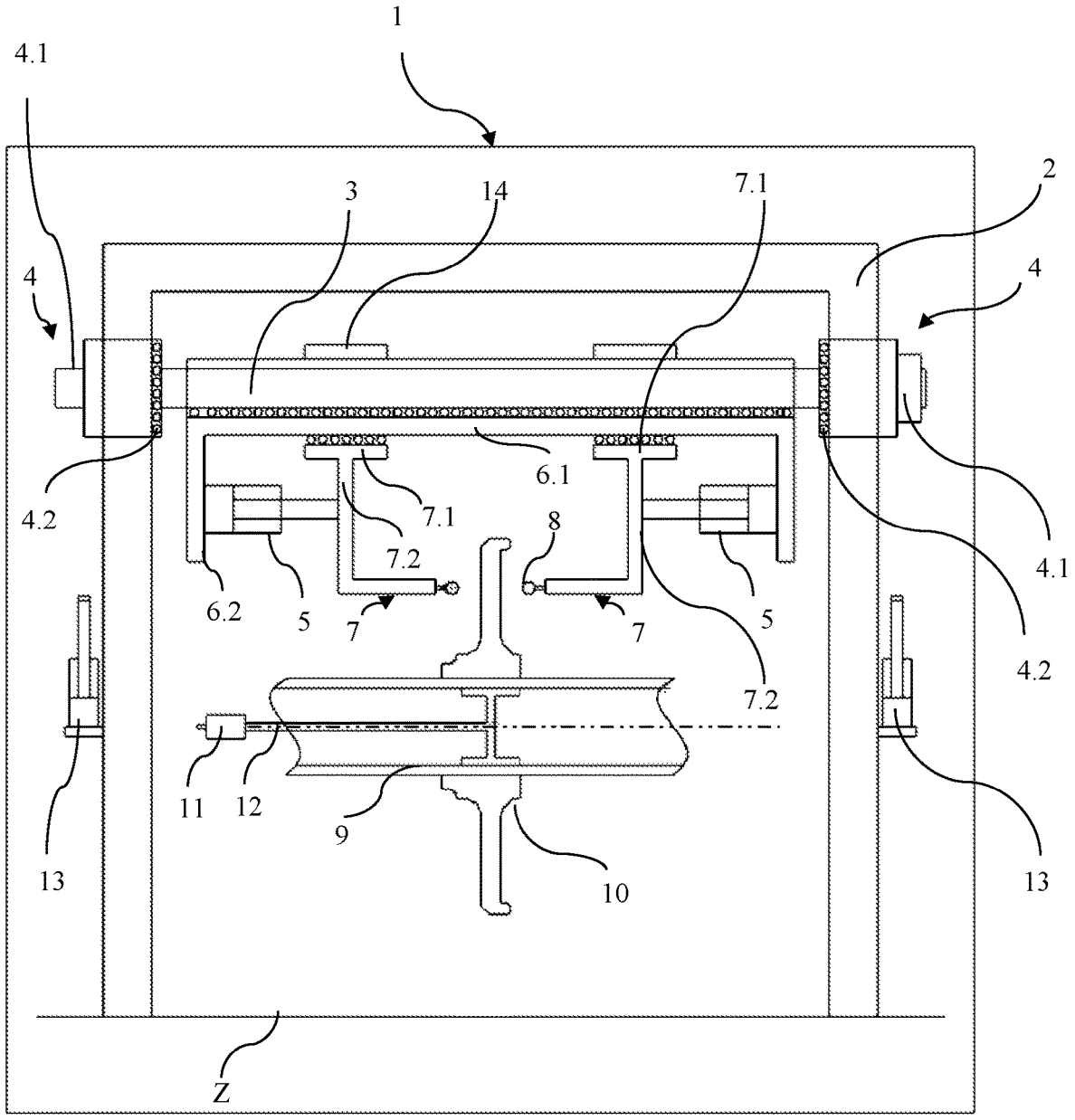
FIG. 3 is front view of a rotational symmetrical and non-symmetrical plastic forming machine with two hydraulic power sources.
Figure 4:
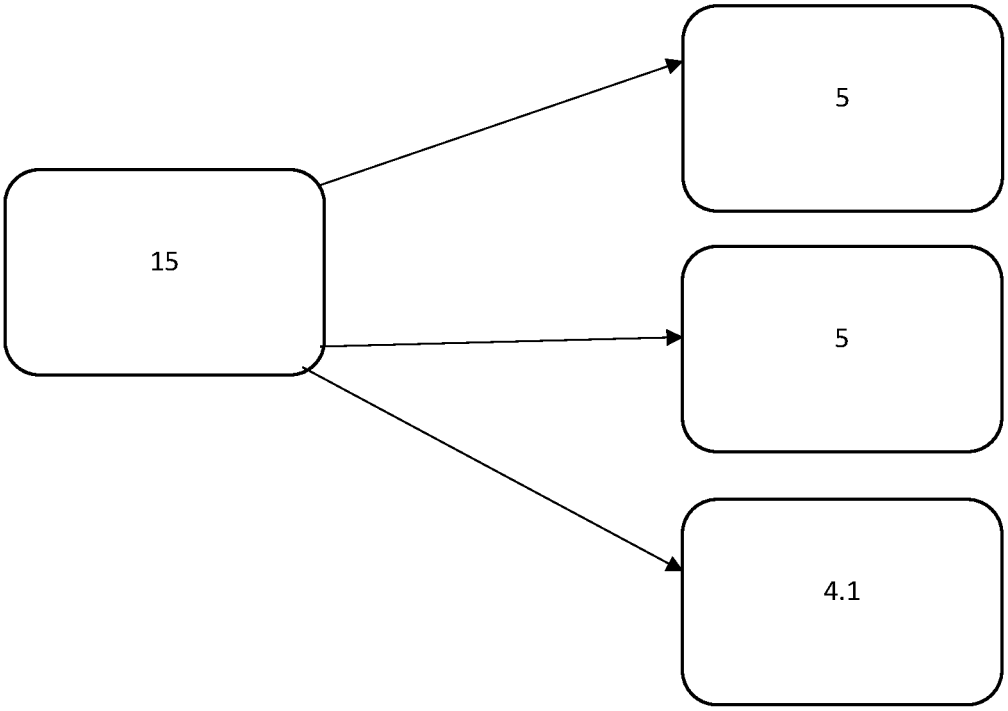
FIG. 4 is flowchart of control unit data transfer.

Plastic forming machine (1) used in another preferred embodiment of the invention is shown in FIG. 3, and essentially comprises at least one fixed pole (2), a movable pole (3) which is positioned such that it will make right angle with the fixed pole (3), comprises at least one upper surface and one lower surface, a linear vertical motor and at least one linear movement system (4) which are for the movable pole (3) moving on a vertical axis on the fixed pole (2), a first pressing rod (6) which is positioned on the lower surface of the movable pole (3), comprises a first arm (6.1) extending parallel to the movable pole (3), a second arm (6.2) and a third arm (6.3) extending vertical to the first arm (6.1), two second pressing rods (7) which comprise a first and a second end, and which is connected to the first arm (6.1) in a sliding manner from its first end, an actuator (5) which is adapted to move the second pressing rods (7) in horizontal axis, and connected to the second arm (6.2) and the third arm (6.3), a contact end (8) connected to the second ends of the second pressing rods (7) and facing each other, a shaft (9) which is for fixing a raw material thereon, an electric motor (11) which is for rotating the shaft (9), a shank (12) one end of which is connected to the outlet of the electric motor and the other end of which is connected to the shaft, at least one control system (15) which is adapted to control the linear movement mechanism (4) and the actuator (5).

The symmetric or non-symmetrical final geometry of the raw material (10) is obtained by means of the plastic forming machine (1) used in this embodiment of the invention. In this embodiment, unlike the first embodiment, the actuator (5) connected to the second arm and the equivalent of the second pressing rod (7) connected to the first arm are positioned on the opposite side symmetrical to the vertical axis. In this embodiment, unlike other embodiments, instead of obtaining symmetrical geometry with two-movement pressing rod using single actuator (5) (FIG. 1), or obtaining non-symmetrical geometry by using a single-movement fixed rod (FIG. 2); both symmetrical and non-symmetrical part geometries can be obtained by means of transferring force equally or in different ratios to the first pressing rod (6) or the second pressing rod (7) by using two different actuators (5).

In this embodiment of the invention, the said linear movement system (4) comprises a linear motor (4.1) and a first linear sliding bearing (4.2) which is driven by the linear motor (4.1), provided between the fixed pole (2) and the movable pole (3) and which comprises a rail mechanism.

The first pressing rod (6) is fixed to the movable pole (3). At the bottom of the first pressing rod (6), there are two second pressing rods (7) and each contact end (8) is connected to each end of the second pressure rods. In an embodiment of the present invention, said second pressing rods (7) preferably comprise a fourth arm (7.1) extending parallel to the first arm (6.1), and a fifth arm (7.2) connected to this fourth arm (7.1), extending towards the floor (Z).

In order to provide the movement of the second pressing rods (7) on the horizontal axis, in other words to move them closer and away from each other, there is an actuator (5) which is connected separately to these second pressing rods (7). While the actuators (5) are connected from one end to the second arm (6.2) and the third arm (6.3) of the first pressing rod (6), it is connected from its other end to the fifth arm (7.2) of the second pressing rod (7). The actuator (5) is preferably a hydraulic piston; it may also be a pneumatic piston or an electric piston.

A raw material (10) is placed between the contact ends (8) of the second pressing rods (7) upon the operation of the actuator (5) in order to be processed peripherally. The said raw material (10) is wrapped around a temperature-controlled and rotatable shaft (9) for peripheral processing. In order to facilitate the processing of the raw material (10), its temperature is controlled via heating plates (not shown in the figures) placed on the inner surface of the shaft (9). The movement of the shaft (9) is provided by an electric motor (11) via a shank (12) engaging to the shaft. The force applied by the actuator (5) is transferred evenly on the raw material (10) through the contact ends (8) connected to the second pressing rods (7). Thanks to the uniform distribution of the force on the second pressing rods (7), it is ensured that the raw material (10) is processed symmetrically.

In the embodiment shown in FIG. 3, in case the same amount of force is transferred by two different actuators (5), the symmetrical part geometry is obtained, and in case different amounts of force is transferred, the non-symmetrical part geometry is obtained. When the third embodiment in FIG. 3 in which two different actuators (5) are used is compared with the second embodiment in FIG. 2 wherein a single actuator (5) and a third arm (6.3) applying constant pressure is used, non-symmetrical geometries can be obtained more easily since the second pressing rods (7) can distribute force in different amounts.

The plastic forming machine (1) comprises a control system (15). The said control system (15) control the position of the movable pole (3), the position of the second pressing rods (7), and the force to be transferred to the raw material (10) to be processed via the contact ends (8) connected to the said rods by controlling the linear movement system (4) and the operation of the actuators (5).

In case the plastic forming machine (1) does not operate, the movement of the movable pole (3) in the vertical direction is limited preferably by means of the stopper pistons (13) positioned on the fixed pole (2).

What is claimed is:

1. A plastic forming machine for shaping a raw material comprising:

at least one fixed pole;

a movable pole positioned at a right angle with the fixed pole and extending parallel to a portion of the fixed pole comprising at least one upper surface and one lower surface;

a shaft for fixing a raw material thereon, wherein the shaft is a temperature-controlled shaft;

an electric motor for rotating the shaft;

a shank, wherein one end of the shank is connected to an outlet of the electric motor and another end of the shank is connected to the shaft;

at least one linear movement system comprising a motor for moving the movable pole on a vertical axis on the fixed pole;

a first pressing rod positioned on the lower surface of the movable pole, comprising a first arm extending parallel to the movable pole, a second arm extending vertical to the first arm, and a third arm comprising a first end and a second end and connected to the first arm from the second end;

a second pressing rod comprising a first and a second end, and the second pressing rod is connected to the first arm in a sliding manner from the first end of the pressing rod;

an actuator adapted to move the second pressing rod in a horizontal axis, and connected to the second arm;

a first contact end connected to the second end of the second pressing rod and a second contact end connected to the second end of the third arm;

at least one control system adapted to control the at least one linear movement system and the actuator, wherein the actuator is configured to implement a relative movement between the second pressing rod and the first pressing rod and wherein the first pressing rod and the second pressing rod have a structure configured to implement the shaping of said raw material via contact of the raw material with the first and second contact ends through force applied by the actuator.

2. The plastic forming machine according to claim 1, wherein, the at least one linear movement system includes two linear movement systems, each of the two linear movement systems comprising a respective motor for enabling the movement of two fixed poles connected to each other.

3. The plastic forming machine according to claim 1, wherein, the at least one linear movement system includes two linear movement systems comprising a linear motor and a first linear sliding bearing driven by the linear motor, provided between the fixed pole and the movable pole.

4. The plastic forming machine according to claim 1, wherein, the third arm has an "L" shaped form.

5. The plastic forming machine according to claim 1, further comprising a linear sliding bearing provided between the first pressing rod and the movable pole so that the first pressing rod can move on the movable pole in the horizontal axis.

6. The plastic forming machine according to claim 1, wherein, the first pressing rod is fixed to the movable pole.

7. The plastic forming machine according to claim 1, wherein the second pressing rod further comprises a fourth arm extending parallel to the first arm and a fifth arm connected to the fourth arm and extending towards a floor.

8. The plastic forming machine according to claim 1, wherein, the actuator is a hydraulic piston, a pneumatic piston, or an electric piston.

9. The plastic forming machine according to claim 1, further comprising at least one stopper piston for limiting the movement of the movable pole in a vertical direction in case the plastic forming machine does not operate.

10. The plastic forming machine of claim 1, wherein the shaping of the raw material is an asymmetric shaping of the raw material and wherein the machine is configured such that the actuator applies different forces via the first and second contact ends to the raw material to implement the asymmetric shaping of the raw material.

11. The plastic forming machine of claim 1, wherein the shaping of the raw material is a symmetric shaping of the raw material and wherein the machine is configured such that the actuator applies a same force via the first and second contact ends to the raw material to implement the symmetric shaping of the raw material.

12. A plastic forming machine for shaping a raw material comprising:

at least one fixed pole;

movable pole positioned at a right angle with the fixed pole and extending parallel to a portion of the fixed pole comprising at least one upper surface and one lower surface;

a shaft for fixing a raw material thereon, wherein the shaft is a temperature-controlled shaft;

an electric motor for rotating the shaft;

a shank, wherein one end of the shank is connected to an outlet of the electric motor and another end of the shank is connected to the shaft;

at least one linear movement system comprising a motor for moving the movable pole on a vertical axis on the fixed pole;

a first pressing rod positioned on the lower surface of the movable pole, comprises a first arm extending parallel to the movable pole, a second arm and a third arm extending vertical to the first arm;

two second pressing rods, each of the two pressing rods having a first and a second end, the two second pressing rods are connected to the first arm in a sliding manner from the first ends of the two second pressing rods;

a first actuator connected to the second arm and a second actuator connected to the third arm, wherein the first actuator is adapted to move one of the two second pressing rods in a horizontal axis, and the second actuator is adapted to move the other of the two second pressing rods in the horizontal axis;

two contact ends facing each other, wherein a first contact end of the two contact ends is connected to the second end of one of the two second pressing rods and a second contact end of the two contact ends is connected to the second end of the other of the two second pressing rods;

at least one control system adapted to control the at least one linear movement system and the first and second actuators, wherein the first and second actuators are configured to implement a relative movement between the second pressing rods, and wherein the second pressing rods have a structure configured to implement the shaping of said raw material via contact of the raw material with the first and second contact ends through forces applied by the first and second actuators.

13. The plastic forming machine according to claim 12, wherein, the at least one linear movement system includes two linear movement systems, each of the two linear movement systems comprising a respective motor for enabling the movement of two fixed poles connected to each other.

14. The plastic forming machine according to claim 12, wherein, the at least one linear movement system includes two linear movement systems comprising a linear motor and a first linear sliding bearing driven by the linear motor, provided between the fixed pole and the movable pole.

15. The plastic forming machine according to claim 12, wherein, the first pressing rod is fixed to the movable pole.

16. The plastic forming machine according to claim 12, wherein the two second pressing rods further comprise a fourth arm extending parallel to the first arm and a fifth arm connected to the fourth arm and extending towards a floor.

17. The plastic forming machine according to claim 12, wherein, the actuator is a hydraulic piston, a pneumatic piston, or an electric piston.

18. The plastic forming machine of claim 12, wherein the first and second actuators are configured to switch between:

a) an asymmetric shaping of the raw material, wherein the first actuator is configured to apply a first force to said raw material via the first contact end of the two contact ends and the second actuator is configured to apply a second force, which is different from the first force, to said raw material via the second contact end of the two contact ends; and b) a symmetric shaping of the raw material, wherein the first actuator is configured to apply a third force to said raw material via the first contact end and the second actuator is configured to apply said third force to said raw material via the second contact end.

* * * * *